US010658796B2

(12) United States Patent
Lüttermann

(10) Patent No.: US 10,658,796 B2
(45) Date of Patent: May 19, 2020

(54) SHIELDING METAL PLATE

(71) Applicant: HARTING Electronics GmbH, Espelkamp (DE)

(72) Inventor: Dieter Lüttermann, Rahden (DE)

(73) Assignee: HARTING Electronics GmbH, Espelkamp (DE)

( * ) Notice: Subject to any disclaimer, the term of this patent is extended or adjusted under 35 U.S.C. 154(b) by 55 days.

(21) Appl. No.: 16/316,418

(22) PCT Filed: Aug. 28, 2017

(86) PCT No.: PCT/DE2017/100721

§ 371 (c)(1),
(2) Date: Jan. 9, 2019

(87) PCT Pub. No.: WO2018/046053

PCT Pub. Date: Mar. 15, 2018

(65) Prior Publication Data

US 2019/0305489 A1 Oct. 3, 2019

(30) Foreign Application Priority Data

Sep. 9, 2016 (DE) ..... 10 2016 116 937

(51) Int. Cl.

| | |
|---|---|
| ***H01R 13/627*** | (2006.01) |
| ***H01R 13/6593*** | (2011.01) |
| ***H01R 13/6582*** | (2011.01) |
| ***H01R 13/58*** | (2006.01) |

(52) U.S. Cl.

CPC ..... *H01R 13/6593* (2013.01); *H01R 13/5837* (2013.01); *H01R 13/6582* (2013.01)

(58) Field of Classification Search

CPC ..... H01R 13/6593; H01R 13/5837; H01R 13/5812; H01R 13/6582; H01R 9/0515; H01R 9/032; H01R 13/6597; H01R 13/6581

USPC ..... 439/357

See application file for complete search history.

(56) References Cited

U.S. PATENT DOCUMENTS

| | | | | |
|---|---|---|---|---|
| 5,456,618 A * | 10/1995 | Nakamura | H01R 13/6581 | 439/607.48 |
| 5,510,574 A | 4/1996 | Wu | | |
| 5,750,923 A | 5/1998 | Wu | | |
| 5,895,291 A | 4/1999 | Furio et al. | | |
| 5,975,955 A * | 11/1999 | Bogiel | H01R 13/6597 | 439/607.56 |
| 6,007,385 A * | 12/1999 | Wu | H01R 13/6582 | 439/607.45 |
| 6,609,934 B2 * | 8/2003 | Chen | H01R 9/032 | 439/607.48 |

(Continued)

FOREIGN PATENT DOCUMENTS

| | | |
|---|---|---|
| DE | 9405156 U1 | 7/1994 |
| DE | 29702513 U1 | 5/1997 |
| DE | 102008037030 | 2/2010 |

*Primary Examiner* — Jean F Duverne
(74) *Attorney, Agent, or Firm* — Smartpat PLC

(57) ABSTRACT

The invention relates to a shielding metal plate (3) suitable for connecting at least one shielded conductor. The shielding metal plate (3), which can be held in a housing of a plug connector, protects the held conductor from external, interfering influences. The shielding metal plate (3) can be variably adapted to different conductor cross-sections such that both thin and thick conductors can be connected.

12 Claims, 2 Drawing Sheets

(56) References Cited

U.S. PATENT DOCUMENTS

| | | | | |
|---|---|---|---|---|
| 6,926,553 | B2 * | 8/2005 | Wu | H01R 9/0515 439/497 |
| 7,074,057 | B2 * | 7/2006 | Chiran | H01R 13/6582 439/607.01 |
| 7,214,097 | B1 * | 5/2007 | Hsu | H01R 13/6593 439/607.47 |
| 7,682,196 | B1 * | 3/2010 | Peng | H01R 13/5812 439/607.54 |
| 8,152,566 | B1 | 4/2012 | Little et al. | |

* cited by examiner

3

SHIELDING METAL PLATE

TECHNICAL FIELD

The disclosure relates to a metal shield for use in an electrical connector.

BACKGROUND

Metal shields are inserted into plug connectors that are needed in order to transmit currents and/or signals. The currents and/or signals are transported to the plug connector by means of a conductor. Said conductor exhibits at least one core. In order that a trouble-free transmission can take place, the conductor is a shielded conductor. The shielding in this case serves for equalization of potential. For the effective removal of interference phenomena potentially arising on the cable shield, a contacting of the cable shield is necessary that is as frequent and/or extensive as possible.

U.S. Pat. No. 5,895,291 A presents a threaded cable gland for a plug connector with attached shield linkage. The shield linkage consists of two gutter-shaped elements. These elements are equipped with a detent option on the side facing toward the conductor. For the purpose of closing, the two halves are pressed together; consequently they close around the conductor in the form of a tube, and hook in a detent option.

An electromagnetic shielding for an electrical connector, as well as the associated electrical connector, is disclosed in DE 10 2008 037 030 B3. The electrical connector exhibits two shielding parts capable of being connected to one another, with a region of the one shielding part and a region of the other shielding part overlapping in an overlay portion.

A disadvantage with the known possibilities is that they do not guarantee the shield transfer directly in/on the plug connector. Furthermore, the known solutions can be utilized only by using auxiliary means such as screws, cable fasteners or crimp regions. In addition, crimped shield linkages, for instance, cannot be disconnected non-destructively. However, an incorrect shield transfer leads to an undesirable, disturbed transmission of the currents and/or signals, which in turn can lead to a malfunction of a coupled device. A further disadvantage of metal shields known hitherto is that the shield transfers cannot be adapted to various conductor cross-sections, so that the appropriate shield transfer always has to be selected for a trouble-free transmission.

SUMMARY

The object of the invention consists in proposing a metal shield that guarantees a simple, reversible, variable and robust contacting of the shield of an electrical conductor.

The object is achieved by the metal shield as claimed.

Advantageous configurations of the invention are specified in the dependent claims.

The present invention relates to a metal shield. Said metal shield has a plug-in side. The plug-in side serves for contacting the plug connector with a mating connector.

Opposite the plug-in side the metal shield has a coupling side. The coupling side serves for coupling at least one electrical conductor. The coupling side preferably serves for coupling at least one electrical shielded conductor.

The conductor is capable of being received in a contact element. The contact element may be a crimp contact, for instance. The at least one contact element is capable of being received in the metal shield and comes into contact with the latter, so that a secure shield transfer is guaranteed.

The metal shield consists of a conductive material, preferably a metal. Alternatively, the metal shield consists of a synthetic material coated with a conductive alloy. The metal shield includes an upper shield member and a lower shield member, each with a coupling portion and a plug-in portion.

The metal shield may be adaptable to various cross-sections of conductors by a latching mechanism. In preferred manner, the upper coupling portion and the lower coupling portion are U-shaped. When the upper coupling portion and the lower coupling portion are joined together, a tube-like, round opening results. A conductor is capable of being inserted into this opening in the direction of the plug-in side.

The upper coupling portion and the lower coupling portion each exhibit detent means. Through the use of the at least one latching mechanism, the metal shield is capable of being employed universally for the most diverse conductor cross-sections, for "thin" and "thick" conductors equally. Thin conductors have a conductor cross-section of less than 2.5 $mm^2$. Thick conductors, on the other hand, have a conductor cross-section greater than or equal to 2.5 $mm^2$.

The shielding of the conductor may either be held between the upper shield member and the lower shield member, from the coupling side as far as the plug-in side. For this purpose, only a possible insulation on the conductor has to be removed. Alternatively, after the removal of the insulation the shielding of the conductor may also be folded over, so that it points from the coupling side in the direction of the coupled conductor, consequently away from the plug-in side. The first variant is advantageous for the coupling of thicker conductors, whereas the second variant is preferably suitable for the coupling of thinner conductors.

By virtue of the at least one latching mechanism, a secure, disconnectable contacting of the shielding is always afforded, irrespective of the conductor cross-section. Consequently a gas-tight contacting obtains which is possible without a laborious manufacture of the conductor.

The at least one latching mechanism includes a first detent lug and an associated first detent recess. The shape of the first detent lug may be round or angular. The first detent recess has accordingly been shaped for receiving the first detent lug, so that the latter is capable of being received in the detent recess in securely latching manner.

In a first variant, the lower coupling portion of the metal shield is provided with at least one first detent lug, and the upper coupling portion with at least one first detent recess. In this case, the first detent lug and the first detent recess have been arranged on the upper coupling portion and on the lower coupling portion in such a way that they are capable of being latched with one another.

In a preferred first practical form, the lower coupling portion is provided with at least one first detent lug. The upper coupling portion exhibits at least two first detent recesses. These at least two first detent recesses ideally take the form of detent steps. The detent steps enable the coupling of various conductor cross-sections, since through the use of the detent steps the spacing between the upper coupling portion and the lower coupling portion is variably adjustable.

In a second, alternative variant, the lower coupling portion exhibits at least one first detent recess, and the upper coupling portion exhibits at least one first detent lug. In this case, the first detent recess and the first detent lug have been arranged on the upper coupling portion and on the lower coupling portion in such a way that they are capable of being latched with one another.

The second variant preferentially includes a lower coupling portion with at least two first detent recesses which take the form of detent steps. As in the first variant, the detent steps serve for variable adaptability to various conductors. The upper coupling portion exhibits at least one first detent lug.

In a further, third variant of the invention, the lower coupling portion exhibits at least one first detent lug. Furthermore, the lower coupling portion exhibits, opposite the first detent lug, at least two first detent recesses. The at least two first detent recesses take the form of detent steps.

Correspondingly, the upper coupling portion exhibits at least one first detent lug. The first detent lug of the upper coupling portion has been arranged appropriately for the latching mechanism in one of the detent steps of the lower coupling portion. In addition, the upper coupling portion exhibits at least two first detent recesses. The latter have been shaped as detent steps and arranged opposite the first detent lug of the upper coupling portion and opposite the first detent lug of the lower coupling portion. The first detent lug of the lower coupling portion can latch in one of the detent steps of the upper coupling portion. This variant offers the advantage of the greatest possible adaptability, since various detent positions are possible on the upper coupling portion and on the lower coupling portion of the metal shield, depending upon the thickness of the conductor.

Regardless of the chosen variant, the at least one first detent lug and the at least one first detent recess have been aligned in the direction of the coupling side. By virtue of the positioning of the at least one first detent lug and the at least one first detent recess on the coupling portions, not only a secure contacting of the shielding but also an early contacting take place. Furthermore, in this way a strain relief for the conductor is afforded at the same time, since the latter is held over a large area.

In one variant, the metal shield has been formed in one piece. This means that the upper plug-in portion and of the lower plug-in portion have been formed from one piece, onto which, corresponding to the respective side, the upper coupling portion and the lower coupling portion have been formed. The upper coupling portion and the lower coupling portion in this case have been designed to be elastic and have been positioned so as to be capable of being latched with one another.

Alternatively, the metal shield has been formed from two parts. In this case, the upper coupling portion and the upper plug-in portion have been formed from one piece; the lower coupling portion and the lower plug-in portion constitute the other piece.

The metal shield exhibits at least one second detent lug on the upper plug-in portion, and at least one associated second detent recess on the lower plug-in portion. Alternatively, the upper plug-in portion exhibits at least one second detent recess, and the lower plug-in portion exhibits at least one second detent lug.

In preferred manner, at least one second detent lug and at least one second detent recess have been formed on the upper plug-in portion, and at least one second detent lug and at least one second detent recess have been formed on the lower plug-in portion in the direction of the plug-in side. As a result, a stable and secure latching is afforded in the region of the complete metal shield.

The at least one second detent lug and the at least one second detent recess are only necessary in the case of multi-part construction of the metal shield.

The second detent recess and the second detent lug may have been constructed to be identical in shape to the first detent lug and to the first detent recess. Alternatively, the second detent lug and the second detent recess may also have a different shape than the first detent lug and the first detent recess. Accordingly, the shape of the first detent lug and of the first detent recess may be angular, and the shape of the second detent lug and of the second detent recess may be elliptical. Alternatively, the shape of the first detent lug and of the first detent recess may be elliptical, and the shape of the second detent lug and of the second detent recess may be angular. In a further alternative, other shapes are also conceivable. With any shape, however, the latching has to be guaranteed.

A third detent lug has been arranged on the upper shield member or on the lower shield member or on the upper shield member and lower shield member. Said lug has been designed to be resilient and elastic and points inward toward an inserted conductor. Said lug has been formed on the coupling side and/or on the plug-in side, the resilient arm of the third detent lug pointing in the direction of the plug-in side. Advantageously, a flexible safety device is generated by this means. The flexible strain relief is afforded when a conductor is pushed from the coupling side into the metal shield in the direction of the plug-in side. In the process, the third detent lug springs slightly away from the inserted conductor. However, the third detent clamps the inserted conductor in its position when said conductor is subjected to traction from the plug-in side to the coupling side. In the process, the third detent lug tightens and in this way secures the inserted conductor. The third detent lug acts in accordance with the principle of Hertzian contact stress and consequently ensures a low-impedance resistance.

A fourth detent lug has been formed on the upper plug-in portion or on the lower plug-in portion or on the upper plug-in portion and on the lower plug-in portion. The fourth detent lug exhibits a resilient arm. The resilient arm points in the direction of the plug-in side. The fourth detent lug serves for latching the entire plug connector with a corresponding mating connector.

The present invention achieves the object of presenting a metal shield having a safe and yet disconnectable shield linkage, it being possible for the shield linkage to be flexibly adapted to the most diverse conductor cross-sections. Furthermore, the shield linkage is constructed to be compact, space-saving and robust. By virtue of the reversible shield linkage, an initial wiring, a correction and/or a repair of a complete plug connector is/are also readily possible.

BRIEF DESCRIPTION OF THE DRAWINGS

An embodiment of the invention is represented in the drawings and will be elucidated in more detail in the following.

DETAILED DESCRIPTION

The figures contain partially simplified, schematic representations. In part, identical reference symbols are used for the same but possibly not identical elements. Different views of the same elements might have been scaled differently.

Figure 1:
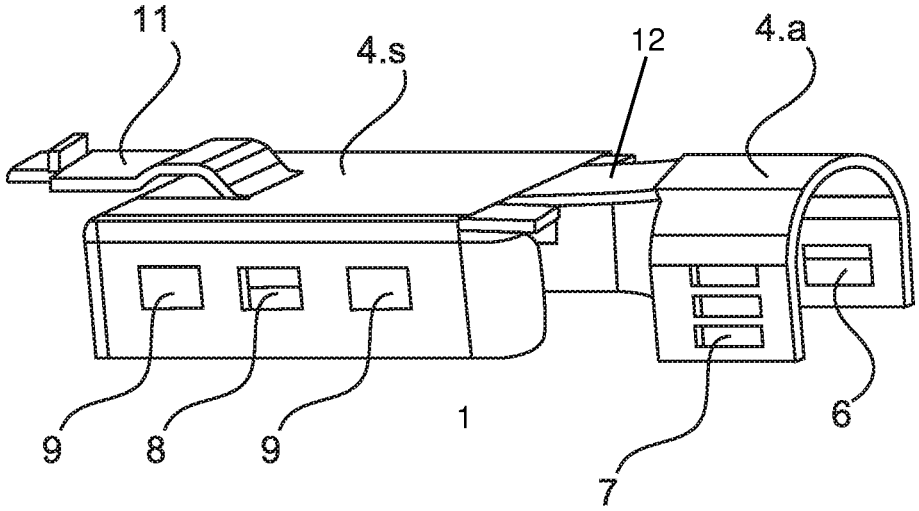
FIG. 1 is a perspective representation of the upper shield member and of the lower shield member of the metal shield.
Figure 1:
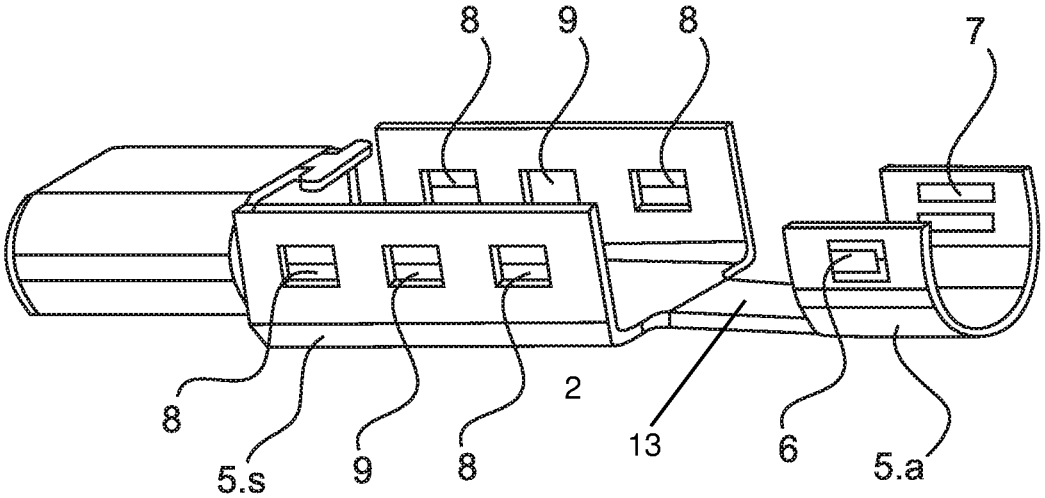

FIG. 1 shows a perspective representation of an upper shield member 1 and of a lower shield member 2, which together form a metal shield 3. The upper shield member 1 includes an upper coupling portion 4.*a* and an upper plug-in portion 4.*s*. The upper plug-in portion 4*s* and the upper coupling portion 4.*a* are connected by an upper arm 12. The lower shield member 2 includes a lower coupling portion 5.*a* and a lower plug-in portion 5.*s* which are connected to one another by a lower arm 13.

This metal shield 3 is capable of being received in a housing of a plug connector. The housing is, in turn, capable of being received in a plug connector. However, for reasons of better representation, the housing and the plug connector have not been shown here.

The lower plug-in portion 5.*s* is constituted by a region for receiving a mating connector. In this region a mating connector can be contacted. The plug-in portion has been designed in the form of a hollow right parallelepiped with two integrally formed semicylinders. One of the two semicylinders has been formed respectively on one of the two short sides of the hollow right parallelepiped. In a mounted state, at least one contact element projects into this region between the two semicylinders.

Opposite the lower plug-in portion 5.*s* the metal shield 3 includes a lower coupling portion 5.*a*. This lower coupling portion serves for coupling at least one shielded conductor, said shielded conductor being capable of being received in a contact element which is then capable of being inserted into the metal shield 3 from the lower coupling portion 5.*a* in the direction of the lower plug-in portion 5.*s*.

The lower coupling portion 5.*a* is U-shaped. Said lower shield member exhibits a first detent lug 6 on the one side, on one leg of the U of the lower coupling portion 5.*a*. The first detent lug 6 is of angular construction. Opposite this first detent lug 6, two first detent recesses 7 have therefore been formed on the correspondingly opposite leg of the lower coupling portion 5.*a*. Use may also be made of any other number of first detent recesses 7. The first detent recess 7 in the present embodiment is of rectangular construction. However, the first detent recesses 7 may assume any shape, which have to be chosen only in accordance with the shape of the first detent lugs 6, in order that those are capable of being received and latched in the first detent recesses 7.

The two first detent recesses 7 have been arranged as detent steps. For this purpose, it is advantageous if at least two first detent recesses have been arranged on the coupling portion. In order that the first detent recesses form detent steps, they have been aligned exactly one above the other in the direction of the opening of the U. This offers the advantage that a corresponding first detent lug is able to catch in various positions, depending upon the conductor cross-section.

The lower coupling portion 5.*a* and the lower plug-in portion 5.*s* are connected by a lower arm 13 which belongs partly to the plug-in portion and partly to the coupling portion. The lower arm 13 connects the base surface of the right parallelipiped of the plug-in portion to the low-point straight line of the U of the coupling portion. A broad rectangular surface with narrow rectangular surfaces formed on the long sides of the broad surface constitutes the lower arm.

Second detent lugs 8 and second detent recesses 9 have been formed on or in the narrow rectangular surfaces. In the present embodiment, on one of the two narrow surfaces the plug-in portion exhibits two second detent lugs 8 and one second detent recess 9. Two second detent lugs 8 and one second detent recess 9 have been arranged on the opposite surface. This is an exemplary distribution of the second detent lugs 8 and the second detent recesses 9. Other distributions/numbers per narrow side are also possible.

The upper shield member exhibits an upper plug-in portion 4.*s*, a upper arm 12 and an upper coupling portion 4.*a*. However, the upper plug-in portion 4.*s* has been designed without the right-parallelepipedal region which has been formed on the lower plug-in portion 5.*s*. The upper arm 12 consists, just as in the case of the lower arm 13, of a broad, rectangular surface with narrow rectangular surfaces formed on the long sides of the broad surface.

The upper plug-in portion includes a fourth detent lug 11. The fourth detent lug 11 is provided for the purpose of latching with a mating connector. Said detent lug has been formed in resilient manner on the broad surface, and points in the direction of the plug-in side. The fourth detent lug 11 is provided with at least one barb—in this case, with two barbs which latch in the mating connector.

On one of the two narrow surfaces, two second detent recesses 9 and one second detent lug 8 have been formed as a counterpart to the lower plug-in portion 5.*s*, with which the upper plug-in portion 4.*s* is capable of being latched. Likewise, two second detent recesses 9 and one second detent lug 8 have been arranged on the opposite narrow surface.

Both narrow surfaces being assembled identically is—as already mentioned in connection with the lower plug-in portion 5.*s*—only one possible practical form. For instance, only one second detent lug 8 may have been arranged on the one narrow surface, and one second detent recess 9 on the opposite narrow surface. The narrow surfaces of the upper plug-in portion 4.*s* must only have been provided with a number of second detent recesses 9 corresponding to the second detent lugs 8 exhibited by the second lower shield member 5.*s*. This applies analogously to the second detent lugs 8 of the second upper shield member 4.*s*.

The upper coupling portion 4.*a* is—like the lower coupling portion 5.*a*—configured in the shape of a U. One leg of the U exhibits a first detent lug 6. Said detent lug has been arranged on the leg in such a way that it is able to engage into one of the first detent recesses 7 of the lower coupling portion 5.*a*. Three first detent recesses 7 have been formed on the opposite leg of the U. Depending on the thickness of the conductor cross-section that is to be received, the first detent lug 6 of the lower coupling portion 5.*a* will latch into one of these three first detent recesses 7.

The same rule applies to the shape of the first detent lug 6 and of the first detent recess 7 on the upper coupling portion 4.*a* as to the first detent recesses 7 and first detent lugs 6 that have been arranged on the lower coupling portion 5.*a*.

The first detent recesses 7 on the upper coupling portion 4.*a* take the form of detent steps analogous to the first detent recesses 7 of the lower coupling portion 5.*a*. They have been arranged correspondingly, one above the other. The number of first detent recesses 7 on the upper coupling portion 4.*a* and on the lower coupling portion 5.*a*, whether identical or different, is arbitrary.

The upper shield members 4.*a*, 4.*s* and also the lower shield members 5.*a*, 5.*s* have consequently been shaped in such a way that they are capable of being latched with one another and hold a received conductor securely. As a result, the shielding of the received conductor is advantageously contacted over a large area.

Figure 2:
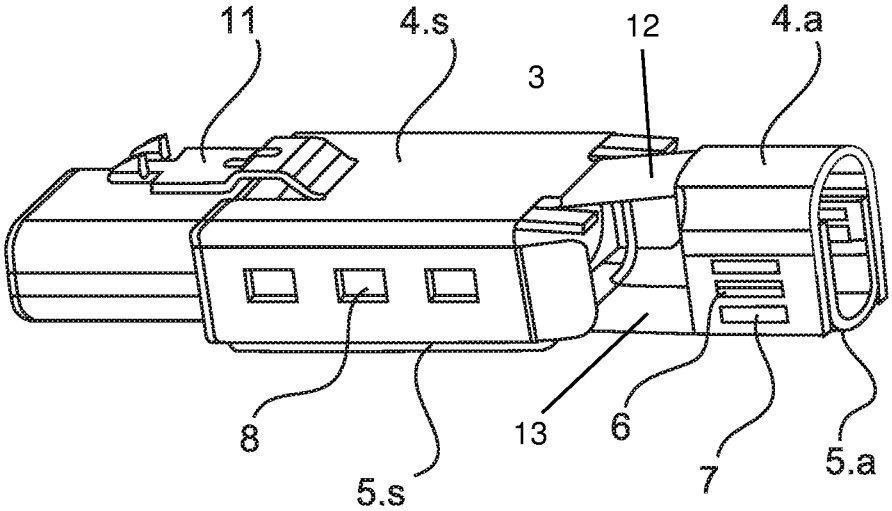
FIG. 2 is a perspective representation of an assembled metal shield.

In FIG. 2 the upper shield member 1 and the lower shield member 2 shown in FIG. 1 have been latched with one another. In FIG. 2 the lower plug-in portion 5.*s* with the right-parallelepipedal and semi-cylindrical plug-in side, the arm, and the lower coupling portion 5.*a* as opposing U-shaped coupling portions are represented.

The fourth detent lug 11 of the upper plug-in portion 4.*s* projects in the direction of the plug-in side and is positioned close to the right-parallelepipedal and semi-cylindrical region of the plug-in side of the lower plug-in portion 5.*s*.

In this embodiment the lower plug-in portion 5.*s* exhibits three second detent recesses 9, into which the three second detent lugs 8 of the upper plug-in portion 4.*s* latch.

On the lower coupling portion 5.*a* a first detent lug 6 has been formed on one leg of the U, toward the observer, and two first detent recesses 7 have been formed on the opposite leg. The upper coupling portion 4.*a* exhibits toward the observer three first detent recesses 7 and, situated opposite, one first detent lug 6. The first detent lug 6 of the lower coupling portion 5.*a* engages into the middle one of the three first detent recesses 7 of the upper coupling portion 4.*a*. The first detent lug 6 of the upper coupling portion 4.*a* latches opposite into the first detent recess 7 of the lower coupling portion 5.*a*, which has been arranged closer to the curved region of the U.

Which first detent recess 7 the respective detent lug 6 has engaged into is dependent on the respective conductor to be coupled.

Figure 3:
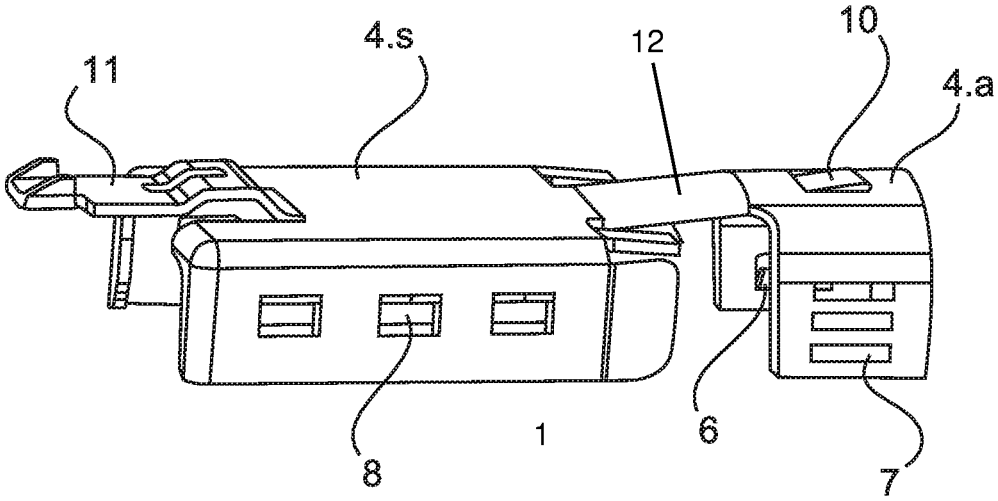
FIG. 3 is a perspective representation of the preferred upper shield member.

In FIG. 3 a preferred practical form of the upper shield member 1 is represented in perspective view. The upper plug-in portion 4.*s* exhibits the fourth detent lug 11 with two barbs in the direction of the plug-in side. In the plug-in portion three second detent lugs 8 have been arranged on the one narrow surface and, situated opposite, three second detent recesses 9.

The upper coupling portion 4.*a* adjoins the upper arm. Said coupling side is U-shaped. Three first detent recesses 7 have been formed on one of the legs of the U. A first detent lug 6 has been formed on the opposite leg of the U.

Particularly preferred is the formation of a third detent lug 10 on the curved region of the U which connects the two legs of the U to one another. The third detent lug 10 offers the advantage of an additional contacting of a shielding of a conductor to be coupled, and is additionally a strain relief. The strain-relieving action is afforded by the orientation of the third detent lug 10, which in the direction of the plug-in side has been formed in resilient manner on the upper coupling portion 4.*a*.

LIST OF REFERENCE SYMBOLS

1 upper shield member
2 lower shield member
3 metal shield
4.*a* upper coupling portion
4.*s* upper plug-in portion
5.*a* lower coupling portion
5.*s* lower plug-in portion
6 first detent lug
7 first detent recess
8 second detent lug
9 second detent recess
10 third detent lug
11 fourth detent lug
12 upper arm
13 lower arm

The invention claimed is:

1. A metal shield having a plug-in side and a coupling side, wherein the coupling side is arranged opposite the plug-in side, wherein the plug-in side is suitable for contacting a mating connector, wherein the coupling side is suitable for coupling at least one shielded conductor, wherein the metal shield has an upper shield member including an upper plug-in portion and a lower shield member including a lower plug-in portion, wherein the metal shield is capable of being received in a housing of a plug connector, wherein the metal shield is adaptable to various conductor cross-sections by a latching mechanism, the latching mechanism comprising:

a generally U-shaped upper coupling portion which is connected to the upper plug-in portion by an upper arm; and a generally U-shaped lower coupling portion which is connected to the lower plug-in portion by a lower arm, wherein open ends of the generally U-shaped upper and lower coupling portions are facing one another, and wherein the upper coupling portion and the lower coupling portion are displaceable relative to one another by bending the upper arm and the lower arm, causing vertical legs of the generally U-shaped upper and lower coupling portions to slide along one another.

2. The metal shield as claimed in claim 1, wherein the latching mechanism comprises a first detent lug and an associated first detent recess.

3. The metal shield as claimed in claim 1, wherein the lower coupling portion includes at least one first detent lug, and the upper coupling portion includes at least one first detent recess.

4. The metal shield as claimed in claim 1, wherein the lower coupling portion includes a first vertical leg and an opposite second vertical leg which are connected by an arcuate central section, and wherein the first vertical leg includes at least one first detent lug, and the second vertical leg includes at least two first detent recesses, the at least two first detent recesses being arranged as detent steps.

5. The metal shield as claimed in claim 1, wherein the lower coupling portion includes at least one first detent recess, and the upper coupling portion includes at least one first detent lug.

6. The metal shield as claimed in claim 5, wherein the lower coupling portion includes at least two first detent recesses, and the upper coupling portion includes at least one first detent lug, the at least two first detent recesses being arranged as detent steps.

7. The metal shield as claimed in claim 1, wherein the lower coupling portion includes a first lower vertical leg and an opposite second lower vertical leg, and wherein the upper coupling portion includes a first upper vertical leg and an opposite second upper vertical leg, and wherein the first lower vertical leg includes at least one first detent lug and the second lower vertical leg at least two first detent recesses, and wherein the first upper vertical leg includes at least two first detent recesses and the second upper vertical leg includes at least one first detent lug.

8. The metal shield as claimed in claim 1, wherein an upper side of the plug-in side and an underside of the plug-in side are arranged on the plug-in side.

9. The metal shield as claimed in claim 8, wherein the upper side of the plug-in side and the underside of the plug-in side are formed from one part, or wherein the upper side of the plug-in side and the underside of the plug-in side are each formed from one part.

10. The metal shield as claimed in claim 1, wherein the upper coupling portion includes vertical legs which are connected by an arcuate central section, and wherein an elastically resilient third detent lug pointing inward toward the at least one conductor is arranged in the central section.

11. The metal shield as claimed in claim 1, wherein the upper side of the plug-in side and/or the underside of the plug-in side include(s) a fourth detent lug, the fourth detent lug being shaped for latching with a mating connector.

12. A metal shield for a connector, comprising:

an upper shield member having an upper plug-in portion and a generally U-shaped upper coupling portion which are connected by an upper arm; and a lower shield member having a lower plug-in portion and a generally U-shaped lower coupling portion which are connected by a lower arm, wherein the upper plug-in portion and the lower plug-in portion are arranged on a plug-in side of the metal shield and configured for contacting a mating connector, wherein the upper coupling portion and the lower coupling portion are configured for coupling at least one shielded conductor, wherein open ends of the generally U-shaped upper and lower coupling portions are facing one another, wherein the upper coupling portion and the lower coupling portion are displaceable relative to one another by bending the upper arm and the lower arm, causing vertical legs of the generally U-shaped upper and lower coupling portions to slide along one another, and wherein the upper coupling portion and the lower coupling portion are latched together by a first detent lug arranged on a vertical leg of the upper plug-in portion which engages a first detent recess arranged on a vertical leg of the lower plug-in portion.

* * * * *